US005329677A

United States Patent [19]

Kanzaka

[11] Patent Number: 5,329,677

[45] Date of Patent: Jul. 19, 1994

[54] FASTENER ASSEMBLY

[75] Inventor: Yoshihiro Kanzaka, Toyama, Japan

[73] Assignee: Yoshida Kogyo K.K., Tokyo, Japan

[21] Appl. No.: 80,708

[22] Filed: Jun. 24, 1993

[30] Foreign Application Priority Data

Jun. 29, 1992 [JP] Japan ..... 4-051412[U]

[51] Int. Cl.[5] ..... A44B 1/18

[52] U.S. Cl. ..... 24/687; 24/662

[58] Field of Search ..... 24/687, 453, 458, 691, 24/662, 94, 96, 103, 104

[56] References Cited

U.S. PATENT DOCUMENTS

| | | | |
|---|---|---|---|
| 2,685,114 | 8/1954 | Reiter | 24/687 |
| 3,925,860 | 12/1975 | Furuya | 24/687 |
| 4,001,924 | 1/1977 | Bengtsson | 24/687 |

FOREIGN PATENT DOCUMENTS

| | | | |
|---|---|---|---|
| 599378 | 1/1933 | Fed. Rep. of Germany | 24/662 |
| 1924539 | 12/1970 | Fed. Rep. of Germany . | |
| 8914775.8 | 3/1990 | Fed. Rep. of Germany . | |
| 358580 | 2/1906 | France | 24/687 |
| 1257129 | 2/1961 | France . | |
| 58-16655 | 4/1983 | Japan . | |

*Primary Examiner*—Laurie K. Cranmer
*Attorney, Agent, or Firm*—Hill, Steadman & Simpson

[57] ABSTRACT

A fastener assembly is adapted for releasably fastening a flap to a body sheet of a briefcase or the like with the flap having a through aperture formed therethrough. The fastener assembly has a male member attached to the flap having a through aperture formed therethrough and a female member attached to the body sheet and having a socket. The male member includes a male member proper mounted on one side of the flap and a separate attachment plate mounted on the other side of the flap. The male member proper has a plug protuberantly extending from the outer side thereof for locking engagement with the socket and a through hole formed therethrough. The attachment plate has a clinching stud protuberantly extending from the inner side thereof. The male member proper and the attachment plate are joined to each other with the flap clamped therebetween. The clinching stud is inserted through the through aperture of the flap and then the through hole of the male member proper and clinched to the outer side of the male member proper.

2 Claims, 4 Drawing Sheets

FASTENER ASSEMBLY

BACKGROUND OF THE INVENTION

1. Field of the Invention

The present invention relates to a fastener assembly, such as a snap button; and applied to an opening in garments, baggages, briefcases, pouches, shoes or other like articles for opening and closing the same.

2. Description of the Prior Art

A typical fastener assembly of the type described is disclosed in Japanese Utility Model Publication No. 58-16655. The conventional fastener assembly is shown to be used on a pouch and comprises a female member mounted on a body of the pouch and a male member mounted on a flap for snap engagement with the female member. The male member is composed of a unitary one-piece plate having a plug protuberantly mounted on one surface thereof. The plate-like male member is folded back around its middle so as to clamp the distal end of the flap between the thus-formed two plate halves thereof. The male member has a through hole formed in either one of the plate halves and has a clinching stud protuberantly mounted on the other half on the inner surface. When the male member is folded back around the distal end of the flap, the clinching stud of the second-mentioned plate half pierces the fabric of the flap and then fitted into the through hole and clinched to the first-mentioned plate half so that the male member is firmly fastened to the distal end of the flap.

However, the conventional fastener assembly suffers the following drawbacks.

The male member composed of a unitary one-piece plate must be folded back around the flap. Making the clinching stud on one half in registry with the through hole of the other half during the folding operation requires very strict precision. If the required precision fails to be met or the thickness of the sheet material of the pouch varies, the clinching stud is likely to come out of registry with the through hole during the folding of the plate-like male member, so that the clinching operation fails. Even if the clinching can be managed at the cost of causing damage around the hole, the resultant male member fastened to the flap is unsightly.

Furthermore, the one-piece plate must undergo folding stresses in its folding axis and also undergo clinching stresses on and around the protuberant stud. This disadvantageously limits the one-piece plate male member in its material, function and its design.

SUMMARY OF THE INVENTION

With the foregoing difficulties in view, it is therefore an object of the present invention to provide a fastener assembly which can be fastened easily and firmly to an opening formed in garments, baggages, briefcases, pouches, shoes or other like articles and which afford a wide freedom in required materials, function and design.

According to the present invention, there is provided a fastener assembly adapted for releasably fastening a first sheet to a second sheet, the first sheet having a through aperture formed therethrough, the fastener assembly comprising a male member attached to the first sheet and a female member attached to the second sheet and having a socket, the male member including a male member proper mounted on one side of the first sheet and a separate attachment plate mounted on the other side of the first sheet, the male member proper having a plug protuberantly extending from the outer side thereof for locking engagement with the socket and a through hole formed therethrough, the attachment plate having a clinching stud protuberantly extending from the inner side thereof, the male member proper and the attachment plate being joined to each other with the first sheet clamped therebetween and with the clinching stud inserted through the through aperture of the first sheet and then the through hole of the male member proper and clinched to the outer side of the male member proper.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 4:
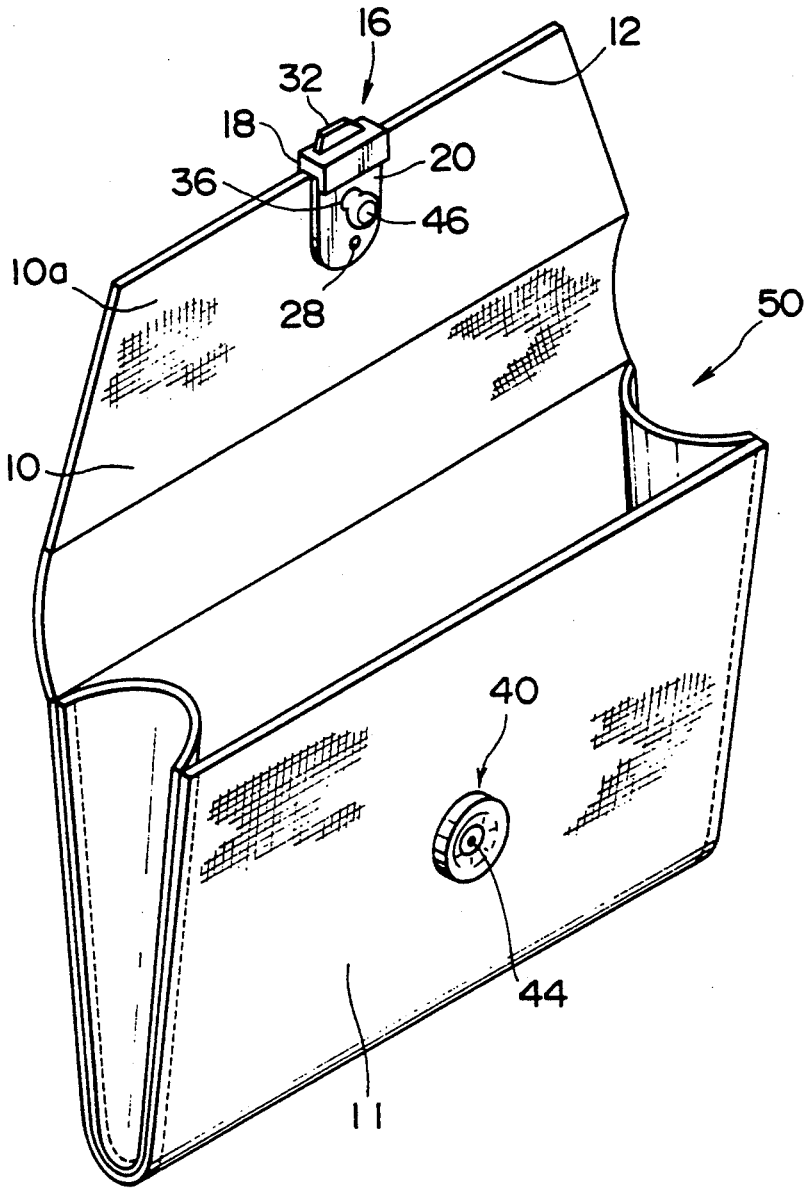
FIG. 4 is a perspective view of a briefcase on which the fastener assembly according to the present invention is used.

FIG. 4 shows a fastener assembly according to the invention being used on a briefcase 50. But, the fastener assembly may be also used on garments, baggages, pouches, shoes or other like articles.

As shown in FIG. 4, the fastener assembly comprises a male member 16 attached to a first sheet such as a flap 10 and a female member 40 attached to a second sheet such as a body sheet 11 of the briefcase 50. The brief case 50 may be made of a sheet material made of fabric, leather or synthetic resin. As better shown in FIG. 1, the flap 10 has a through hole 14 formed therethrough adjacent to its distal end 12.

Figure 1:
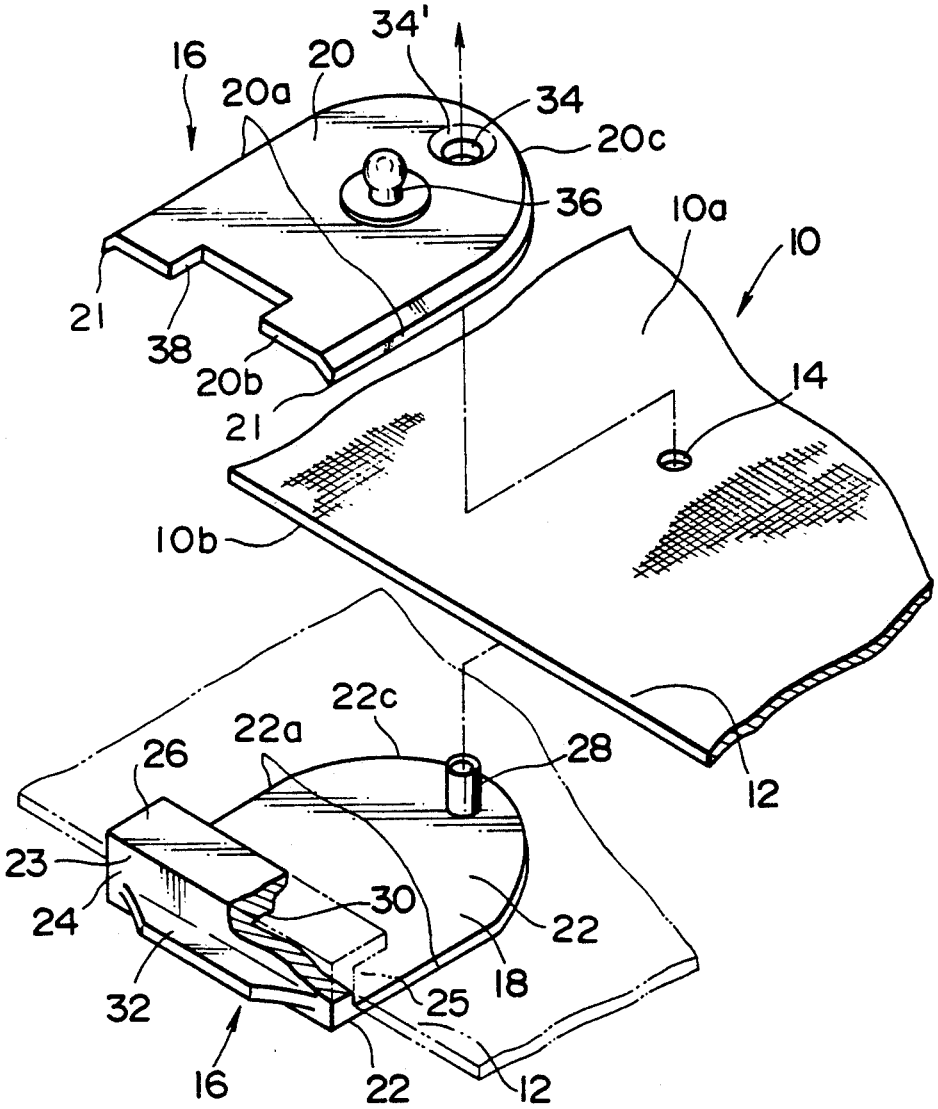
FIG. 1 is an exploded, perspective view of a male member of a fastener assembly according to the present invention prior to being mounted on a flap.
Figure 2:
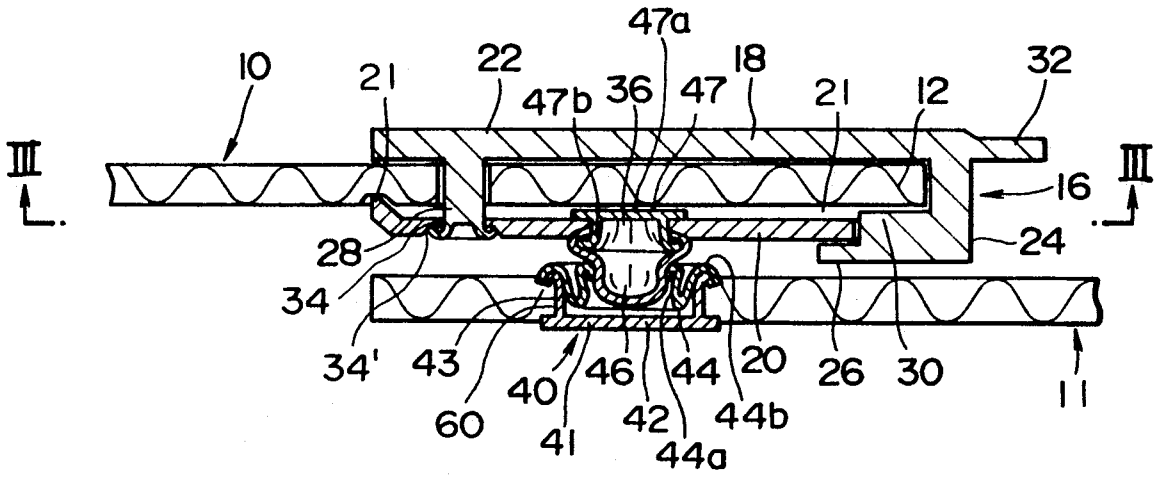
FIG. 2 is an enlarged vertical cross-sectional view of the male member of FIG. 1 attached to the flap and snapped with a female member attached to a body sheet of a briefcase.

As also shown in FIG. 1, the male member 16 comprises a male member proper 20 mounted on one side 10*a* of the flap 10 and a separate attachment plate 18 mounted on the other side 10*b* of the flap 10. The male member proper 20 is a substantially arch-headed-rectangular flat plate which is defined jointly by a pair of opposed sides 20*a*, 20*a*, an arcuate end 20*c* and a linear end 20*b*. A plug 36 extends protuberantly from the plate-like male member 20 and is disposed substantially from its middle. As shown in FIG. 2, the plug 36 includes an attachment base 47 and a coupling head 46. The attachment base 47 has a base plate 47*a* and a cylindrical wall 47*b* integrally mounted on one side of the base plate 47*a*. The coupling head 46 is firmly fastened to the upper rim of the cylindrical wall 47*b* of the attachment base 47 with the male member proper 20 clamped between the coupling head 46 and the base plate 47*a*.

As better shown in FIG. 1, a through hole 34 is formed through the male member proper 20 adjacent to the arcuate end 20*c*. The through hole 34 is countersunk at 34' so as to receive a flattened end of a clinching stud 28 of the attachment plate 18, as further described hereinbelow. The male member proper 20 has a continuous bevelled edge 21 formed along the opposed sides 20*a*, 20*a* and the arcuate end 20*c*. The male member proper 20 has a rectangular recess 38 formed in the linear end 20*b* thereof.

Figure 3:
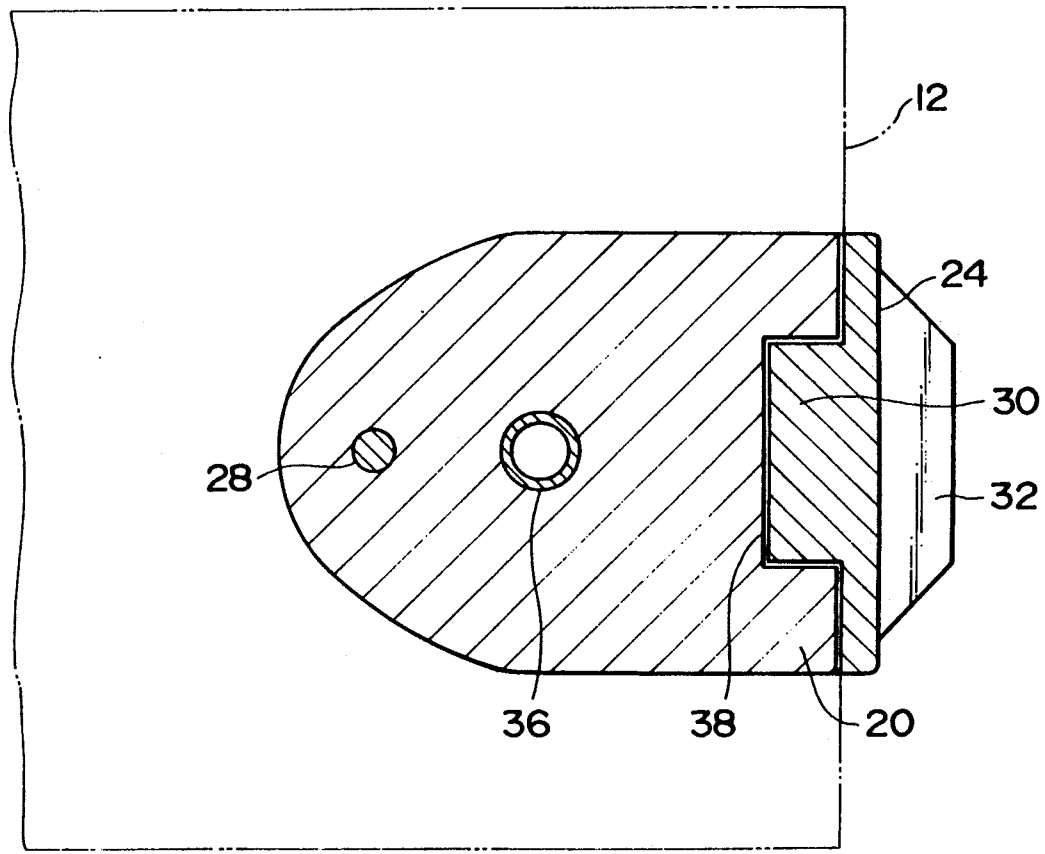
FIG. 3 is a cross-sectional view taken generally along line III—III of FIG. 2.

As better shown in FIG. 1, the attachment plate 18 broadly comprises a front wall 22 and a channel portion 23 formed integrally therewith. The front wall 22 is substantially identical in shape and size with the male member proper 20 and is defined by a pair of opposed sides 22*a*, 22*a*, an arcuate end 22*c* and a linear end 22*b*. The channel portion 23 comprises an end wall 24 extending substantially perpendicularly from the linear end 22*b* of the front wall 22 and a cantilevered wall 26 extending inward from the upper edge of the end wall 24 in parallel with the front wall 22, the end wall 24 and the cantilevered wall 26 defining a furrow 25 with the front wall 22. An elongated projecting ridge 32 is provided on the outer side of the end wall 24 so as to extend longitudinally in the middle thereof. As shown in FIGS. 1 through 3, the cantilevered wall 26 has a rectangular locking lug 30 mounted on its inner side. As better shown in FIG. 3, the locking lug 30 is complementary in depth and width with the rectangular recess 38 for snugly receiving the same recess 38. As better shown in FIG. 2, the thickness of the locking lug 30 is equal to or slightly greater than the thickness of the the male member proper 20.

For assembling the male member 16, as indicated by phantom lines in FIG. 1, first, the flap 10 is placed flat on the inner side of the front wall 22 of the attachment plate 18 with its end 12 fitted into the furrow 25 and abutting against the inner side of the end wall 24 and with its through aperture 14 pierced by the clinching stud 28. Then, the male member proper 20 is placed on the upper side 10*a* of the flap 10 with the linear end 20*b* fitted into furrow 25 and abutting against the inner side of the end wall 24 and with its through hole 34 pierced by the clinching stud 28. In this instance, the locking lug 30 of the attachment plate 18 comes into locking engagement with the recess 38 of the male member proper 20, as better shown in FIG. 3. Eventually, the clinching stud 28 protruding beyond the through hole 34 is clinched on the countersink 34' so that the male member proper 20 is firmly joined to the attachment plate 18 with the flap 10 clamped therebetween as better shown in FIG. 2. In this event, the continuous bevelled edge 21 of the male proper 20 comes into wedging engagement with the flexible fabric of the flap 10, which advantageously allows for varying thicknesses of the flap 10.

As shown in FIG. 2, the female member 40 comprises an attachment base 41 and an annular coupling socket 44 jointed to the the attachment base 41. The attachment base 41 has a base plate 42 and a cylindrical wall 43 integrally mounted on one side of the base plate 42. The annular coupling socket 44 has a resilient cylindrical socket body 44*a* and a flared rim 44*b* extending radially from the cylindrical socket body 44*a*. For assembling the female member 40, first the cylindrical wall 43 of the attachment base 41 is fitted through a through hole 60 of the body sheet 11 of the briefcase 50, up from the lower surface. Then, the annular coupling socket 44 is fastened to the attachment base 42 by curling or caulking the flared radial rim 44*b* of the annular coupling socket 44 to the upper rim of the cylindrical wall 43, so that the female member 40 is fastened to the body sheet 11.

For closing the flap 10, as shown in FIG. 2, the coupling head 46 of the plug 36 is pressed into snapping engagement with the resilient cylindrical socket body 44*a* of the female member 40. And, for opening the flap 10, the projecting ridge 32 is gripped and lifted by fingers so that the coupling head 46 of the plug 36 comes out of engagement with the socket body 44*a* of the female member 40.

With the construction set forth hereinabove, the fastener assembly according to the present invention enjoys the following advantages:

Since the male member 16 of the fastener assembly according to the present invention is of a two-piece construction and comprises the male member proper 20 and the separate attachment plate 18, the male member 16 can be attached to a sheet with ease and without regard to the thickness of the sheet clamped between the male member proper 16 and the attachment plate 20.

The male member proper 20 and the separate attachment plate 18 can be designed independently from each other, thus providing an ample freedom for designing.

With the locking engagement between the locking recess 38 and the locking lug 30, the male member proper 20 can be firmly retained to the attaching plate 18 even by only one clinching stud 28.

The flap 10 and the male member proper 20 can be placed in situ on the attachment plate 18 with great ease simply by inserting the end 12 of the flap 10 and the end of the male member proper 18 into the furrow 25 of the attachment plate 18.

The male member proper 20 is fastened to the flap 10 with its bevelled edges 21 wedging into the upper surface of the flap 10, so that the fastener assembly is firmly attached to the flap 10.

Since the male member proper 20 has its beveled edges 21 wedged into the flap 10, the fastener element allows for the use of variant thickness of the flap 10.

Obviously, the skilled person would realize that various modifications and variations of the present invention are possible in the light of the above teaching. It is, therefore, to be understood that within the scope of the appended claims the invention may be practiced otherwise than as specifically described, and that the invention is not limited to the embodiments described above in detail.

What is claimed is:

1. A fastener assembly adapted for releasably fastening a first sheet to a second sheet, the first sheet having a through aperture formed therethrough, the fastener assembly comprising a male member attached to the first sheet and a female member attached to the second sheet and having a socket, the male member including a male member proper mounted on one side of the first sheet and a separate attachment plate mounted on the other side of the first sheet, the male member proper having a plug protuberantly extending from an outer side thereof for locking engagement with the socket and a through hole formed therethrough, the attachment plate having a clinching stud protuberantly extending from an inner side thereof, the male member proper and the attachment plate being joined to each other with the first sheet clamped therebetween and with the clinching stud inserted through the through aperture of the first sheet and then the through hole of the male member proper and clinched to the outer side of the male member proper, the attachment plate including a front wall and a channel portion mounted along one end thereof so as to define with an inner side of the front wall a furrow, one edge of the first sheet and one edge of the male member proper being fitted in the furrow.

2. A fastener assembly according to claim 1, wherein the channel portion having in its furrow a locking lug, the male member proper having in said one end a locking recess for snugly receiving the locking lug.

* * * * *